United States Patent [19]

Banks, Jr.

[11] 4,164,952

[45] Aug. 21, 1979

[54] HAIR WAVING DEVICE

[76] Inventor: Edward D. Banks, Jr., 1312 Kansas Ave., Kansas City, Kans. 66105

[21] Appl. No.: 825,653

[22] Filed: Aug. 18, 1977

[51] Int. Cl.[2] ..... A45D 2/24

[52] U.S. Cl. ..... 132/37 R

[58] Field of Search ..... 132/37 R, 32, 40, 41, 132/148, 118

[56] References Cited

U.S. PATENT DOCUMENTS

| | | | |
|---|---|---|---|
| 861,596 | 7/1907 | Machado | 132/32 R |
| 1,455,696 | 5/1923 | Wright | 132/32 R |
| 1,637,893 | 8/1927 | Beskow | 132/38 R |
| 2,377,877 | 6/1945 | Graham | 132/38 R |

*Primary Examiner*—G. E. McNeill

*Attorney, Agent, or Firm*—John A. Hamilton

[57] ABSTRACT

A hair waving device consisting of a pair of perforated, wave-form plates adapted to receive a lock of hair therebetween, and adjustable latch means operable to interconnect the plates to secure them in place on the lock of hair, and to accommodate any lack of parallelism of the general planes of the plates.

4 Claims, 3 Drawing Figures

HAIR WAVING DEVICE

This invention relates to new and useful improvements in hair waving devices, and has particular reference to a device for use in imparting a permanent wave to ladies' hair.

The permanent waving process is of course extremely common, but is commonly quite laborious and tedious, virtually always including the winding of the hair, separated into separate locks, on numerous generally cylindrical "curlers", whereby the hair is held in a desired form while it is treated with a chemical waving solution, neutralizer solution, etc. The overall object of the present invention is the provision of a device which, while functioning efficiently to hold the hair in a desired form as it is treated with the waving solutions, is much easier to apply to the hair than the usual roll-type curlers, and requires a much smaller number of units for the entire head than would be required if roll-type curlers were used. Generally, this object is accomplished by the provision of a pair of wave-form plates adapted to receive a lock of hair therebetween, and latch means operable to join said plates, after the hair lock is positioned, to clamp the hair therebetween. The plates may be of any desired length, parallel to the hair strands, and are perforated to permit free access to the hair by the waving solutions.

Another object is the provision of a device of the character described in which the plates are so configurated that, while still functioning to position the hair in the desired wave form, nevertheless actually engage and clamp the lock of hair only at spaced apart transverse lines along the length of the hair. This leaves much of the hair lock free of contact with the plates, so that it is more freely accessible to the waving solutions applied thereto through the perforations of the plates.

A further object is the provision of a device of the character described in which the latch means for securing the plates together is of a special type which is capable of clamping the lock of hair firmly therebetween despite any uneveness or taper in the thickness of the hair lock. Otherwise stated, it is capable of connecting said plates firmly despite deviations of the general planes thereof from parallel relation. In this connection, it is preferable that said plates be of flexible construction.

Other objects are simplicity and economy of construction, each device consisting essentially of only two parts, and efficiency, dependability and convenience of operation.

Figure 1:
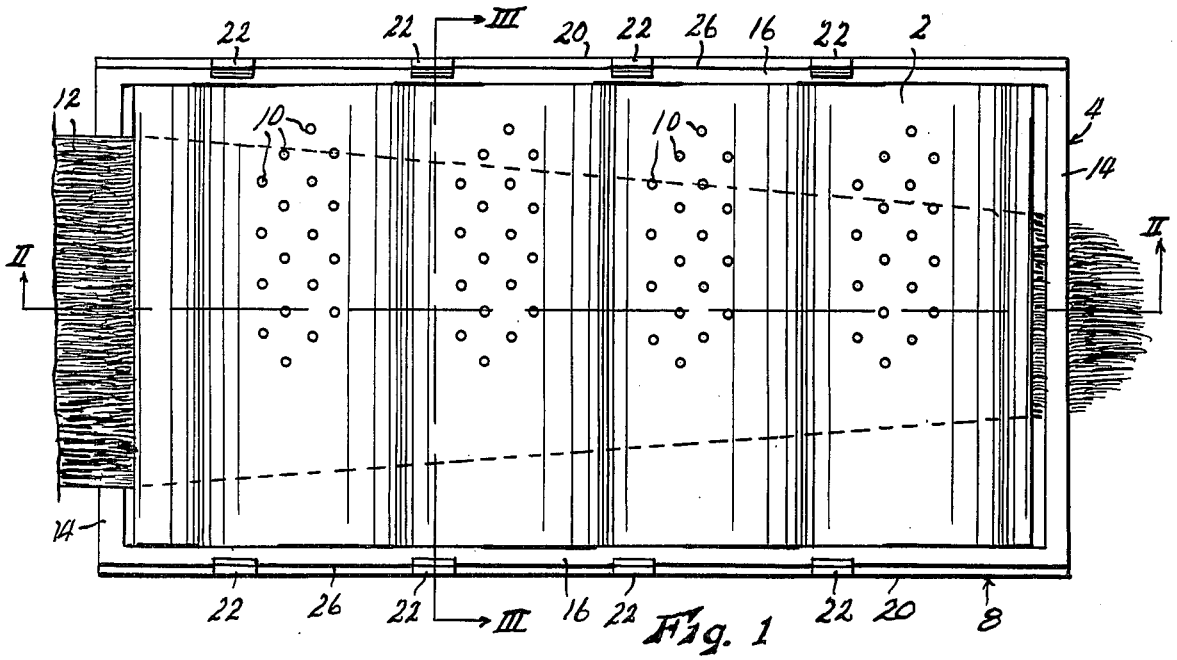
Figure 2:
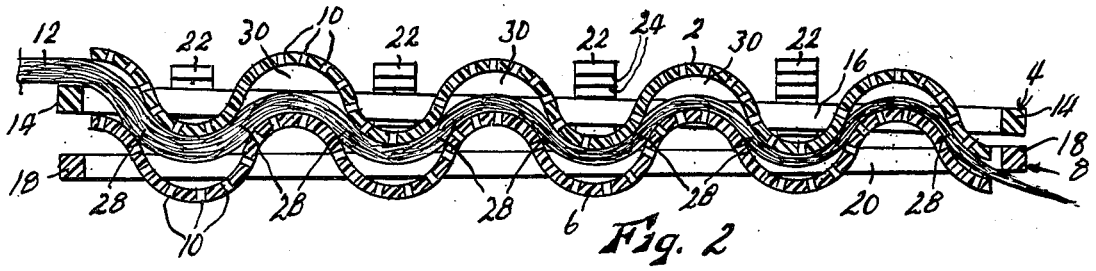
Figure 3:
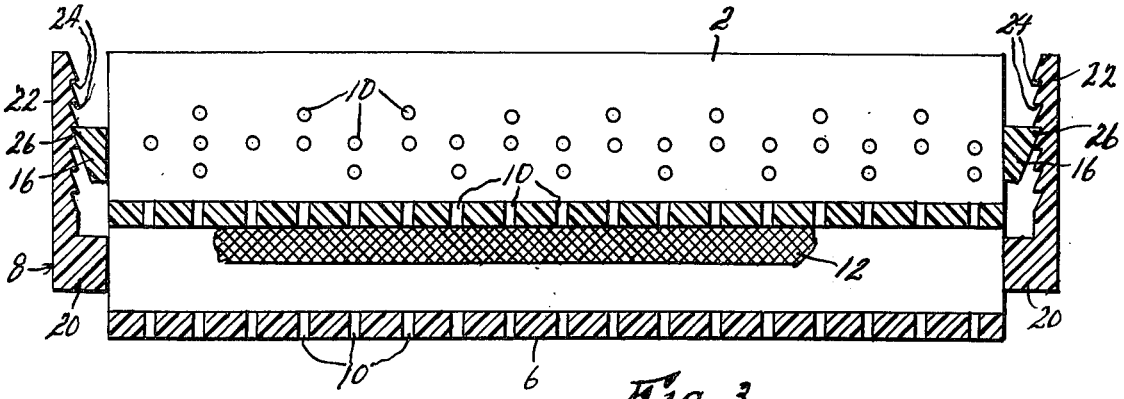

With these objects in view, as well as other objects which will appear in the course of the specification, reference will be had to the accompanying drawing, wherein:

FIG. 1 is a top plan view of a hair waving device embodying the present invention, operatively applied to a lock of hair, FIG. 2 is a sectional view taken on line II—II of FIG. 1, and FIG. 3 is an enlarged sectional view taken on line III—III of FIG. 1.

Like reference numerals apply to similar parts throughout the several views. The hair waving device contemplated by the present invention includes, generally, a top plate 2 having a frame 4, and a bottom plate 6 having a frame 8. Plates 2 and 6 are designated "top" and "bottom" merely as a convenience, the designation having no particular significance so far as their actual relative position is use is concerned. Ordinarily, when the device is applied to a lock of hair, plate 6 would be disposed closest to the head, and plate 2 disposed outwardly therefrom. The plates are shown as rectangular, although their shape is in this respect optional, are formed preferably of a resiliently flexible material, such as certain types of molded plastic, and are perforated as indicated at 10. It will be understood that substantially the entire area of said plates are perforated. They are molded to any desired wave form, as shown having a smoothly rounded corrugated form, with the corrugations straight and extending across the minor dimensions of the plates. This however, is by way of example only, since the wave form can be of many different configurations as desired, to produce different hair stylings. The corrugations could, for example, be curved transversely of the plates, could be more or less sharply curved, and could be more or less widely spaced. As shown, their confronting faces are such as to permit full area contact therebetween if laid together. This provides that when they are spaced apart by the presence of a lock of hair 12 therebetween, the spacing therebetween at the peaks of the corrugations will be greater than at points midway between the peaks, which produces a desirable result to be described.

The plate frames 4 and 8 are formed of the same resiliently flexible material as the plates, and have the form of open rectangles each closely surrounding its associated plate. Top frame 4 has straight end bars 14 and side bars 16, said side bars intersecting the edge of plate 2 at each corrugation thereof, while bottom frame 8 has straight end bars 18 and side bars 20, said side bars intersecting the edge of plate 6 at each corrugation thereof. The side bars of each frame are either permanently attached to the associated plate, or molded integrally therewith, the latter alternative rendering each plate and its frame a one-piece structure.

The plates, when pressed toward each other to clamp the hair lock 12 therebetween, are secured by the engagement of latch fingers 22 of the side bars 20 of frame 8 with the side bars 16 of frame 4. A series of fingers 22 are spaced regularly along each side bar 20, and extend at right angles to the frame 8 to project past the outer edges of side bars 16 of frame 4. Said fingers are flexibly resilient, being formed integrally with side bars 20. As best shown in FIG. 3, the inner face of each finger, which is the surface thereof confronting side bar 16 of top frame 4, has a vertically spaced series of downwardly facing, horizontally extending notches 24 formed therein, and each side bar 16 of the top frame is bevelled to form a tooth 26 capable of engaging selectively in any one of said notches. Fingers 22 are spread resiliently apart by side bars 16 as the top plate is pressed downwardly over the bottom plate, in order that teeth 26 may "ratchet" downwardly over notches 24 to engage in any selected notch, but then recover resiliently to secure the plates together. The fingers at the opposite sides of the plates must be manually spread apart to allow separation of the plates.

In the operation of the device, the plates are separated and a lock of hair 12 is laid over the top surface of bottom plate 6, substantially in the relationship thereto shown in the drawing. In the drawing, the left end of the lock of hair, as shown in FIGS. 1 and 2, is the end closest to the head. Top plate 2 is then positioned over the bottom plate and the lock of hair to press the hair therebetween, the side bars 16 of top frame 4 ratcheting downwardly between fingers 22 of the bottom frame until the desired degree of pressure is applied to the hair, at which position side bars 16 will be engaged and held by one of the notches 24 of each finger 22. Application of the device is then complete, and the waving solution, neutralizer solution, etc. may be applied to the lock of hair in the waving process, which in itself forms no part of the present invention. The solutions are applied to the hair through the perforations 10 of the plates. After the treatment of the hair is completed, the plates may be removed by manually spreading the fingers 22 at the opposite sides of the plates, as previously discussed.

An important feature of the invention is the form and operation of the latching action provided by fingers 22. Under frame side bars 16 need not engage in corresponding notches 24 of all of the fingers, but may engage in different notches of the respective fingers. This permits the plates to be finally secured in a position slightly convergent toward the free end of the lock of hair, as illustrated in FIG. 2, thus providing that the hair lock is held firmly along substantially its entire length, despite the fact that it normally will be taperingly reduced in thickness toward its free end. Frame 4 may also be engaged in different notches of corresponding fingers at opposite sides of the plates, thus causing a relative lateral tilting of the plates. This tends to accomodate the device to a lock of hair which may taper in thickness from side to side, as may occur when it is poorly arranged preparatory to clamping it between the plates. Either or both of these accomodations may result in some distortion of the plates from their normal configurations, and for this reason it is important that said plates be formed of material which is resiliently flexible. Of course, any desired number of notches 24 could be provided in each of fingers 22, to permit any desired degree of fineness of these adjustments. However, the operator need not concern himself with these adjustments, they occur automatically when the plates are pressed together with a generally uniform pressure over their areas.

The wave configuration of the plates is also an important feature of the invention, that is, their cross-sectional configuration. Their configuration in the general planes of the plates, as already discussed, is optional and a matter largely determined by the desired hair styling. As shown, the plates have a smoothly curved waveform, with their confronting surfaces capable of full area contact if laid together. So long as this is true, it will be seen from a consideration of FIG. 2 that when they are slightly separated by the presence of a lock of hair therebetween, the vertical spacing between the plates at the peaks of the corrugations will be greater than the spacing therebetween at points midway between the peaks, as indicated at points 28 in FIG. 2. Thus when the plates are pressed together as previously described, they engage the lock of hair principally along transverse lines of the plates at points 28. As the plates are finally pressed together, their contact with the hair along transverse lines at points 28 tends to apply a longitudinal tension to the lock of hair, pulling the hair smoothly and tautly over the rounded convex peaks of the plate at the "inside" of each corrugation, and away from the rounded concave peaks of the plate at the "outside" of each corrugation, opening crescent shaped spaces 30 therebetween. The tensioning of the hair preserves the desired form of the lock of hair even in the portions thereof engaged only at one side by a plate, i.e. at spaces 30, whereby to maintain the desired form of the hair when the chemical waving solution is subsequently applied thereto through perforations 10, while the opening of spaces 30 provides a much freer access of the waving solution to the hair, than if the plates had full area contact with the hair. Virtually the entire length of the lock of hair is exposed to an open chamber 30, in which the waving solution may flow freely. This circulation promotes faster, more thorough penetration of the lock of hair by the waving solutions.

While I have shown and described a specific embodiment of my invention, it will be readily apparent that many minor changes of structure and operation could be made without departing from the spirit of the invention.

What I claim as new and desire to protect by Letters Patent is:

1. A hair waving device comprising:

a. a pair of plates similarly corrugated in rounded wave form to receive a lock of hair therebetween transversely to the corrugations thereof to impart a longitudinally sinuous form to said lock of hair, and b. latch means operable to secure said plates releasably together whereby to clamp said lock of hair therebetween, said latch means being adjustable to clamp said plates together when the general planes of said plates are disposed in variably non-planar relation, either longitudinally or transversely of the corrugations thereof.

2. A device as recited in claim 1 wherein said latch means comprises a plurality of fingers affixed to one of said plates in spaced apart relation along a pair of opposite edges thereof so as to be disposed at opposite sides of said lock of hair, said fingers extending transversely to the general plane of said one plate to project beyond the corresponding edges of the other of said plates, and means for releasably securing any of a series of longitudinally spaced apart points of each of said fingers to the corresponding edge of said other plate, whereby said plates are secured to clamp said lock of hair therebetween.

3. A device as recited in claim 2 wherein said plates are formed of resiliently flexible material, whereby their general planes may be distorted by securing the edges of said other plate to points of said fingers unequally spaced from said one plate.

4. A device as recited in claim 2 wherein said fingers are formed of resiliently flexible material, the fingers at the opposite sides of said one plate being spaced apart just sufficiently to admit said other plate therebetween, and wherein said securing means constitutes a series of longitudinally spaced apart, transverse notches formed in the face of each finger confronting the adjacent edge of said other plate, said other plate having a tooth operable to engage selectively in any one of the notches of each finger, whereby when said plates are pressed together to clamp said lock of hair therebetween, the teeth of said other plate force opposite fingers resiliently apart and ratchet over the notches of said fingers until the lock of hair is engaged with the desired clamping force, said plates being formed of resiliently flexible material.

* * * * *